US008977155B2

(12) United States Patent
Shimura

(10) Patent No.: US 8,977,155 B2
(45) Date of Patent: Mar. 10, 2015

(54) IMAGE FORMING APPARATUS

(75) Inventor: Yasuhiro Shimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 153 days.

(21) Appl. No.: 13/576,873

(22) PCT Filed: Mar. 16, 2011

(86) PCT No.: PCT/JP2011/057072

§ 371 (c)(1),
(2), (4) Date: Aug. 2, 2012

(87) PCT Pub. No.: WO2011/115301

PCT Pub. Date: Sep. 22, 2011

(65) Prior Publication Data

US 2012/0308252 A1 Dec. 6, 2012

(30) Foreign Application Priority Data

Mar. 18, 2010 (JP) ..... 2010-062464
Feb. 8, 2011 (JP) ..... 2011-024986

(51) Int. Cl.
*G03G 15/20* (2006.01)

(52) U.S. Cl.
CPC .... *G03G 15/2078* (2013.01); *G03G 2215/2035* (2013.01)
USPC ..... 399/67; 399/33; 399/37; 399/90

(58) Field of Classification Search
USPC ..... 399/33, 37, 67, 90
See application file for complete search history.

(56) References Cited

U.S. PATENT DOCUMENTS

| | | | | |
|---|---|---|---|---|
| 5,229,577 | A | 7/1993 | Matsuura et al. | |
| 7,116,923 | B2 | 10/2006 | Kishi et al. | |
| 7,193,180 | B2 * | 3/2007 | Cook et al. | 399/69 |
| 7,630,662 | B2 | 12/2009 | Namiki et al. | |
| 2004/0247334 | A1 | 12/2004 | Kishi et al. | |

(Continued)

FOREIGN PATENT DOCUMENTS

| | | | |
|---|---|---|---|
| JP | 7-121055 | A | 5/1995 |
| JP | 7-199702 | A | 8/1995 |

(Continued)

OTHER PUBLICATIONS

European Search Report dated Oct. 25, 2013, in counterpart European Application No. 11756483.1-1560 / 2548083.

(Continued)

*Primary Examiner* — Ryan Walsh
(74) *Attorney, Agent, or Firm* — Fitzpatrick, Cella, Harper & Scinto

(57) ABSTRACT

The image forming apparatus can be used in areas having different power supply voltages, in which a failure of the apparatus can be detected so that reliability of the apparatus is improved. The apparatus includes a connection state switching part which switches connection of a first heat generating member and a second heat generating member, which generate heat by electric power supplied from a commercial power supply through a power supply path, between a serial connection state and a parallel connection state, and a current detection part which detects current flowing in the power supply path. The current detection part is disposed in the power supply path after branching toward the first heat generating member and the second heat generating member in the parallel connection state.

9 Claims, 12 Drawing Sheets

(56) References Cited

U.S. PATENT DOCUMENTS

| | | | |
|---|---|---|---|
| 2010/0206865 | A1 | 8/2010 | Jaccard et al. |
| 2010/0310267 | A1 | 12/2010 | Shimura et al. |
| 2011/0280596 | A1 | 11/2011 | Shimura |
| 2011/0280597 | A1 | 11/2011 | Shimura et al. |
| 2012/0000897 | A1 | 1/2012 | Shimura |
| 2012/0121306 | A1 | 5/2012 | Shimura et al. |
| 2012/0201581 | A1 | 8/2012 | Shimura |
| 2012/0201582 | A1 | 8/2012 | Shimura et al. |

FOREIGN PATENT DOCUMENTS

| | | | | |
|---|---|---|---|---|
| JP | 10-319777 | A | | 12/1998 |
| JP | 11143304 | A | * | 5/1999 |
| JP | 2001-312179 | A | | 11/2001 |
| JP | 2002-040849 | A | | 2/2002 |
| JP | 2004-302362 | A | | 10/2004 |
| JP | 2005-258317 | A | | 9/2005 |
| JP | 3919670 | B2 | | 5/2007 |
| JP | 2007-212503 | A | | 8/2007 |
| JP | 2008-233367 | A | | 10/2008 |
| JP | 2008233367 | A | * | 10/2008 |
| JP | 2010-199066 | A | | 9/2010 |

OTHER PUBLICATIONS

International Search Report (PCT/ISA/210) and Written Opinion of the Searching Authority (PCT/ISA/237) dated Apr. 19, 2011 in International Application No. PCT/JP2011/057072.

Sep. 27, 2012 Notification Concerning Transmittal of International Preliminary Report on Patentability in PCT/JP2011/057072, International Preliminary Report on Patentability in PCT/JP2011/057072, and Apr. 19, 2011 Written Opinion of International Searching Authority in PCT/JP2011/057072.

English-language translation of Korean Office Action dated Feb. 27, 2014, issued in counterpart Korean Application No. 10-2012-7026480.

Korean Office Action dated Feb. 27, 2014, issued in counterpart Korean Application No. 10-2012-7026480.

Korean Office Action dated Aug. 7, 2014, issued in counterpart Korean Application No. 10-2014-7014252.

Chinese Office Action dated Sep. 28, 2014, issued in counterpart Chinese Application No. 201180013724.4, and English-language translation thereof.

* cited by examiner

IMAGE FORMING APPARATUS

TECHNICAL FIELD

The present invention relates to an image forming apparatus such as a copier or a laser beam printer, and particularly, to an image forming apparatus including a fixing part which heat-fixes an image formed on a recording material to the recording material.

BACKGROUND ART

When an image forming apparatus for an area where the commercial power supply voltage is a 100 V system (for example, 100 V to 127 V) is used in an area where the commercial power supply voltage is a 200 V system (for example, 200 V to 240 V), the maximum power that can be supplied to a heater of a fixing part (fixing device) of the image forming apparatus becomes four times as large. If the maximum power that can be supplied to the heater increases, harmonic currents, flickers, and the like generated in electric power control of the heater such as phase control or wave number control become conspicuous. In addition, because the electric power generated when the fixing device exhibits thermal runaway without normal operation increases by four times, it is necessary to have a safety circuit with quicker response. Therefore, when the same image forming apparatus is used in areas where the commercial power supply voltage is 100 V and where the commercial power supply voltage is 200 V, it is common to use individual heaters having different resistance values for the respective areas by replacement.

On the other hand, as means for realizing a universal apparatus that can be used in both areas where the 100 V commercial power supply voltage is supplied and where the 200 V commercial power supply voltage is supplied, there is proposed a method involving switching the resistance value of the heater using a switching unit such as a relay. In Patent Literatures 1 and 2, there is proposed an apparatus that can be used in both areas where the commercial power supply voltage is 100 V and where the commercial power supply voltage is 200 V. The apparatus includes a first heat generating member and a second heat generating member, and can switch between a first operating state in which the first heat generating member and the second heat generating member are connected in series and a second operating state in which the first heat generating member and the second heat generating member are connected in parallel, thereby switching the resistance value of the heat generating member according to the commercial power supply voltage.

CITATION LIST

Patent Literature

PTL 1: Japanese Patent Application Laid-Open No. H07-199702

PTL 2: U.S. Pat. No. 5,229,577

SUMMARY OF INVENTION

Technical Problem

The method involving switching between the serial connection state and the parallel connection state of the first heat generating member and the second heat generating member according to the commercial power supply voltage enables to switch the resistance value of the heater without changing a heat generating region of the heater. In other words, both the two heat generating members generate heat when the apparatus is used in any of the areas of 100 V and 200 V. The above-mentioned method involving switching between the serial connection and the parallel connection is effective particularly in the fixing device including an endless belt, a heater that is brought into contact with an inner surface of the endless belt, and a pressure roller which forms a fixing nip part with the heater through the endless belt. This is because both two heat generating members generate heat when the apparatus is used in any of the areas of 100 V and 200 V so that temperature distribution in the recording material conveyance direction in the fixing nip part is the same regardless of the area where the apparatus is used. Therefore, there is a merit that the fixing performance of a toner image is not affected by the area where the apparatus is used.

However, the above-mentioned method may cause a state in which excess electric power can be supplied to the heater when a power supply voltage detection part or a resistance value switching relay fails. For example, if the parallel connection state in which the heater resistance value is low is set in the state in which the image forming apparatus is connected to the 200 V commercial power supply, the electric power that is four times larger than that in the normal state can be supplied to the heater. Because the electric power supplied to the heater becomes too large, the safety circuit using a temperature detecting element such as a thermistor, a thermal fuse, or a thermal switch may be insufficient in the response speed for cutting off the electric power supply to the heater. Therefore, in the apparatus that can switch the resistance value, it is necessary to detect a failure state in which large electric power can be supplied to the heater by other method than the method of detecting temperature.

An object of the present invention is to provide an image forming apparatus capable of detecting a failure of the apparatus, in which connection of a first heat generating member and a second heat generating member can be switched between a serial connection state and a parallel connection state.

Solution to Problem

In order to solve the above-mentioned problem, an image forming apparatus according to the present invention includes:

a fixing part including a first heat generating member and a second heat generating member which generate heat by electric power supplied from a commercial power supply through a power supply path to heat-fix an image formed on a recording material to the recording material;

a connection state switching part which switches connection of the first heat generating member and the second heat generating member between a serial connection state and a parallel connection state; and a current detection part which detects a current flowing in the power supply path, in which the current detection part is disposed in the power supply path after branching toward the first heat generating member and the second heat generating member in the parallel connection state.

Further, an image forming apparatus according to the present invention includes:

a fixing part including a first heat generating member and a second heat generating member which generate heat by electric power supplied from a commercial power supply through a power supply path to heat-fix an image formed on a recording material to the recording material;

a connection state switching part which switches connection of the first heat generating member and the second heat generating member between a serial connection state and a parallel connection state; and a voltage detection part which detects a voltage, in which the voltage detection part is disposed so as to detect one of a voltage generate both ends of the first heat generating member and a voltage generate both ends of the second heat generating member in the serial connection state.

Advantageous Effects of Invention

According to the present invention, it is possible to detect the failure of the apparatus, in which the connection of the first heat generating member and the second heat generating member can be switched between the serial connection state and the parallel connection state.

Further features of the present invention will become apparent from the following description of exemplary embodiments with reference to the attached drawings.

DESCRIPTION OF EMBODIMENTS

Hereinafter, exemplary embodiments of the present invention are described in detail with reference to the attached drawings.

First Embodiment

Figure 9:
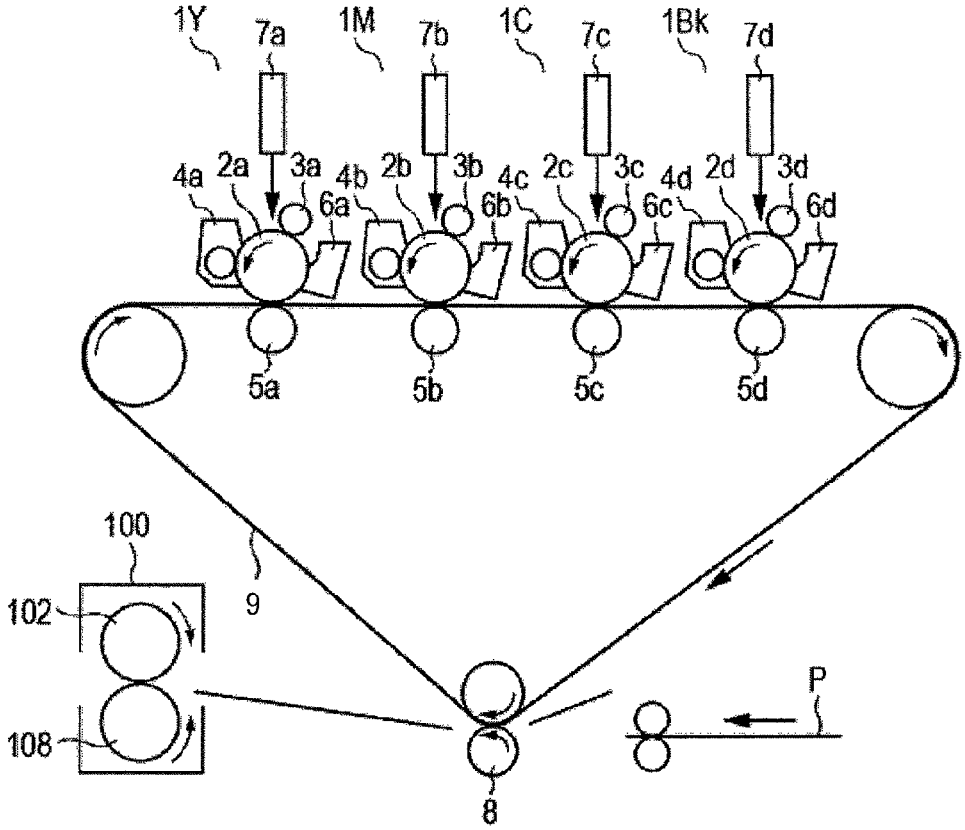
FIG. 9 is a schematic diagram of an image forming apparatus.

FIG. 9 is a cross sectional view of an image forming apparatus (full color printer in this embodiment) using an electrophotography. An image forming part which forms a toner image on a recording material P includes four image forming stations (1Y, 1M, 1C, and 1Bk). Each of the image forming stations includes a photosensitive member 2 (2*a*, 2*b*, 2*c*, or 2*d*), a charge member 3 (3*a*, 3*b*, 3*c*, or 3*d*), a laser scanner 7 (7*a*, 7*b*, 7*c*, or 7*d*), a developing device 4 (4*a*, 4*b*, 4*c*, or 4*d*), a transferring member 5 (5*a*, 5*b*, 5*c*, or 5*d*), and a cleaner 6 (6*a*, 6*b*, 6*c*, or 6*d*) which cleans the photosensitive member. Further, the image forming part includes a belt 9 which bears and conveys a toner image, and a secondary transfer roller 8 which transfers the toner image from the belt 9 to the recording material P. The action of the image forming part described above is well known, and hence description thereof is omitted. The recording material P on which the unfixed toner image is transferred in the image forming part is conveyed to a fixing part 100 in which the toner image is heat-fixed to the recording material P.

Figure 1:
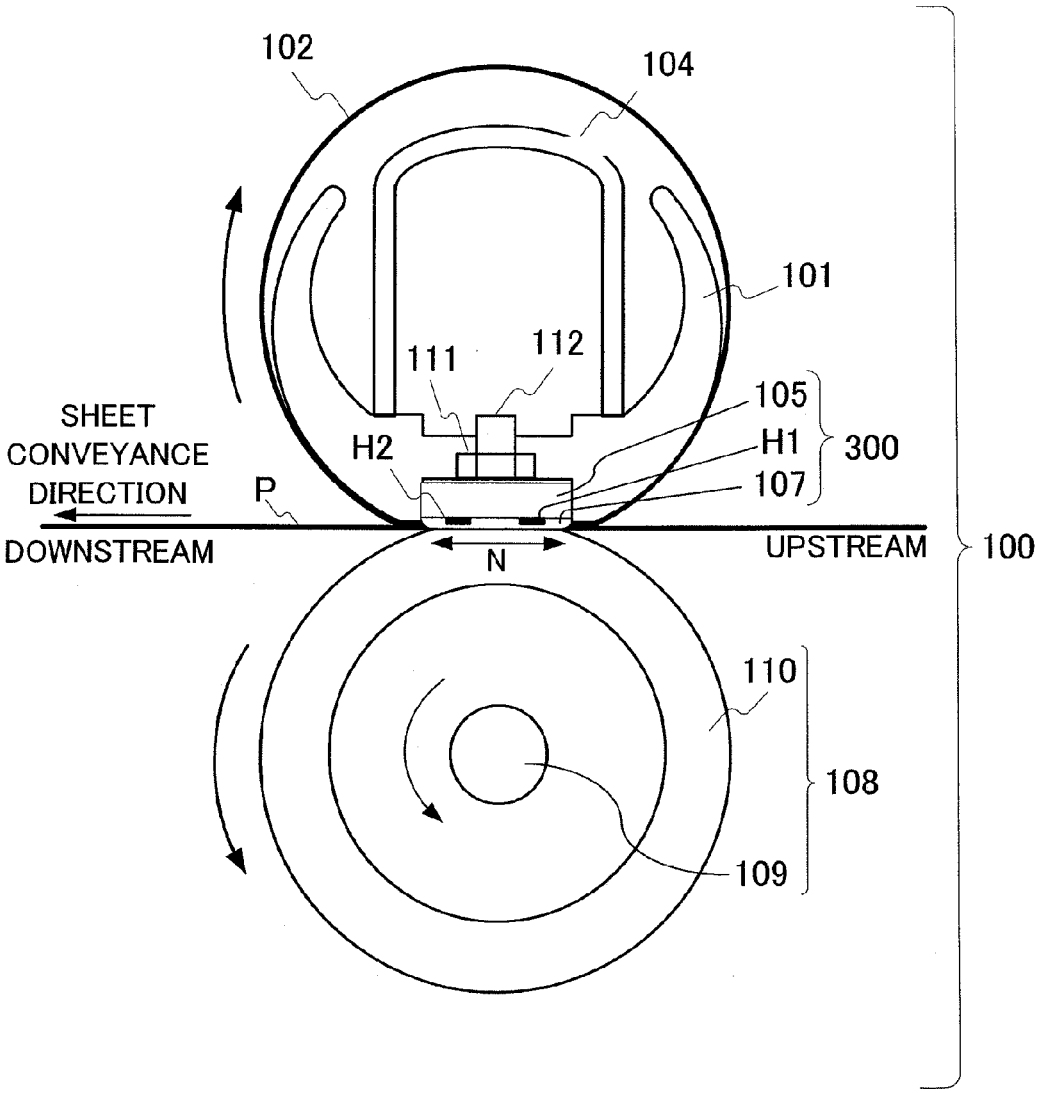
FIG. 1 illustrates a cross section of an image heating device of the present invention.

FIG. 1 is a cross sectional view of the fixing device (fixing part) 100 which heat-fixes the image on the recording material to the recording material. The fixing device 100 includes a film (endless belt) 102 rolled in a cylindrical shape, a heater 300 that is brought into contact with an inner surface of the film 102, and a pressure roller (nip part forming member) 108. The pressure roller 108 and the heater 300 together form a fixing nip part N through the film 102. The film 102 has a base layer made of a heat-resistant resin such as a polyimide or a metal such as stainless. The pressure roller 108 includes a core metal 109 made of iron, aluminum, or the like and an elastic layer 110 made of silicone rubber or the like. The heater 300 is held by a retentioning member 101 made of a heat-resistant resin. The retentioning member 101 also has a guide function of guiding the rotation of the film 102. The pressure roller 108 is powered by a motor (not shown) and rotated in a direction of the arrow. Along with the rotation of the pressure roller 108, the film 102 is rotated accompanying the rotation of the pressure roller 108.

The heater 300 includes a heater substrate 105 made of ceramics, a first heat generating member H1 and a second heat generating member H2 each formed on the heater substrate by using a heat resistor, and a surface protective layer 107 made of an insulating material (glass in this embodiment) covering the first heat generating member H1 and the second heat generating member H2. The heater substrate 105 has a back surface formed as a sheet feeding area for passing a minimum size sheet (envelop DL size, which is 110 mm in width in this embodiment) set as usable in a printer. A temperature detecting element 111 such as a thermistor abuts against the sheet feeding area. According to the temperature detected by the temperature detecting element 111, power to be supplied from a commercial alternating current (AC) power supply to the heater is controlled. The recording material (sheet) P for bearing the unfixed toner image is subjected to fixing processing in the fixing nip part N, in which the recording material P is pinched and conveyed while being heated. A safety element 112 such as a thermo-switch also abuts against the back surface side of the heater 105. The safety element 112 is actuated when the heater 300 experiences an abnormal temperature rise, and cuts off a power feed line (power supply path) to the heater. Similarly to the temperature detecting element 111, the safety element 112 also abuts against the sheet feeding area for the minimum size sheet. A metal stay 104 is employed for applying a spring pressure (not shown) to the retentioning member 101.

Figure 2A:
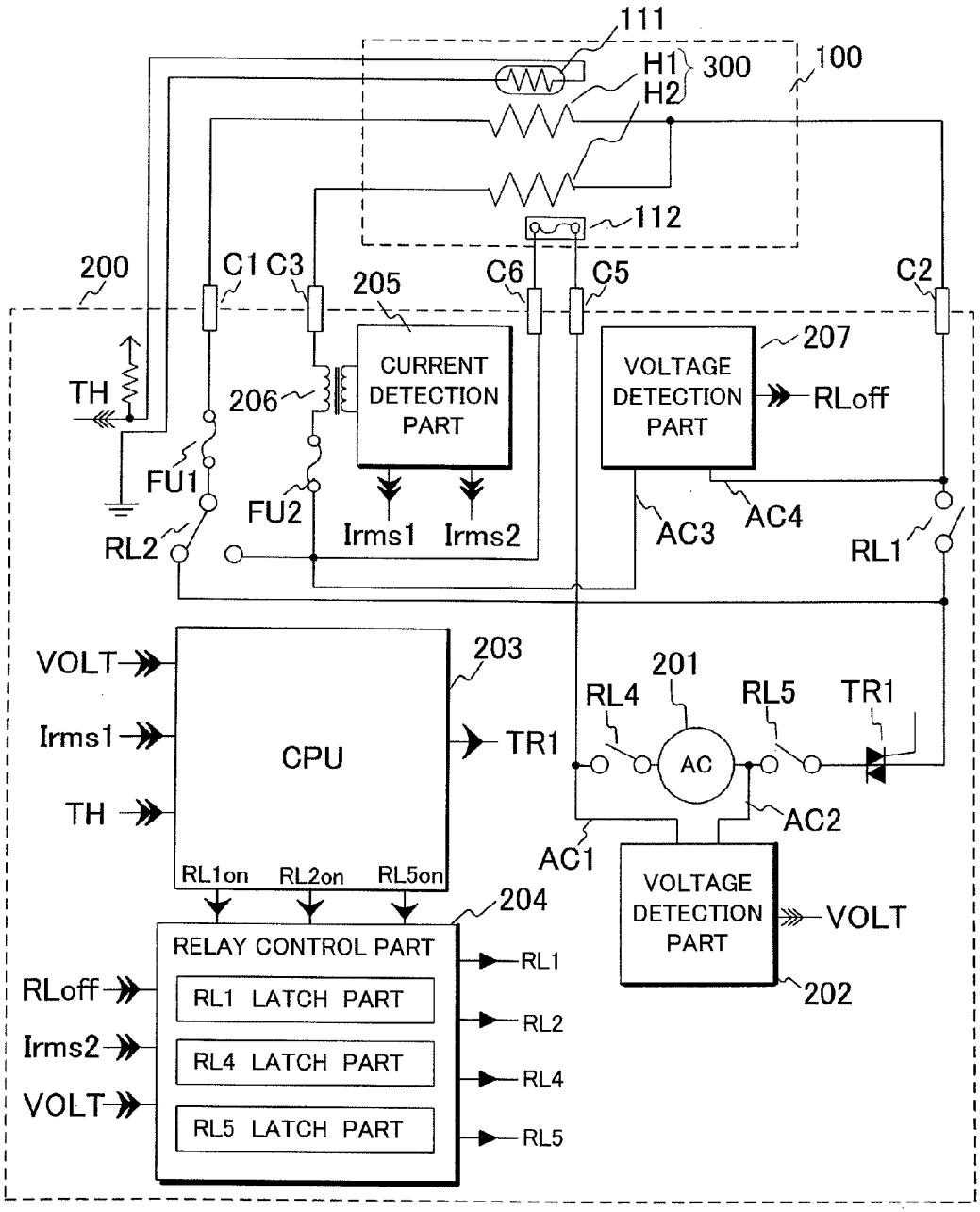
FIG. 2A illustrates a structure of a heater control circuit of a first embodiment.
Figure 2B:
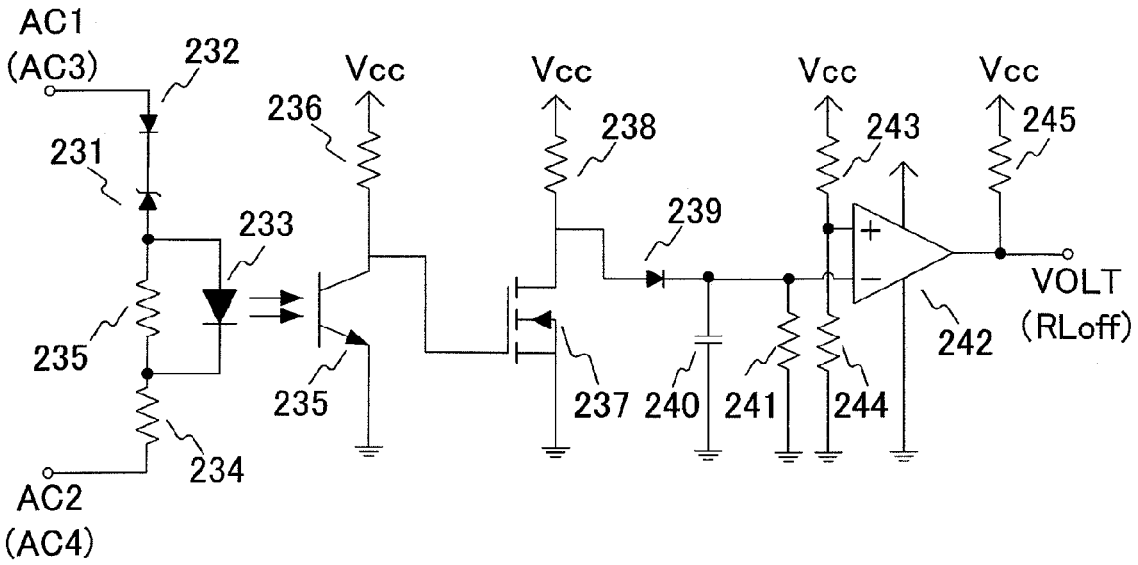
FIG. 2B illustrates a circuit of a voltage detection part of the heater control circuit of the first embodiment.

FIGS. 2A and 2B illustrate a control circuit 200 for the heater 300 of the first embodiment. FIG. 2A is a circuit block diagram illustrating the control circuit 200, and FIG. 2B is a circuit diagram illustrating a voltage detection part (power supply voltage detection part) 202 and a voltage detection part (second voltage detection part) 207.

The control circuit 200 is described with reference to FIG. 2A. The control circuit 200 includes connectors C1, C2, C3, C5, and C6 for connection between the control circuit 200 and the heater 300. The control circuit 200 also includes a commercial AC power supply 201, and electric power control to the heater 300 is performed by turning on and off a triac TR1 (semiconductor driving device). The triac TR1 operates according to a heater drive signal from a CPU 203. The temperature detected by the temperature detecting element 111 is obtained as a divided voltage of a pull-up resistor and is supplied to the CPU 203 as a TH signal. As an internal process of the CPU 203, the electric power to be supplied is calculated by, for example, PI control based on the detected temperature by the temperature detecting element 111 and set temperature of the heater 300, and the calculated result is converted into a control level such as a phase angle (for phase control) or a wave number (for wave number control) so as to control the triac TR1 by the duty cycle ratio according to the control level.

Next, a description is given of the power supply voltage detection part 202 which detects a voltage of the commercial power supply 201, and a relay control part (control part) 204 which controls a connection state switching part (relays RL1 and RL2) according to the detected voltage by the power supply voltage detection part 202. Note that, a detailed relay control sequence is described with reference to FIGS. 5A and 5B.

As illustrated in FIG. 2A, there are disposed relays RL1, RL2, RL4, and RL5. FIG. 2A illustrates connection states of the relays in the power supply OFF state of the image forming apparatus. The relays RL1 and RL2 function as the connection state switching part which switches connection of the first heat generating member H1 and the second heat generating member H2 between a serial connection state and a parallel connection state. Note that, it is supposed that RL1 has a make contact or a break contact. In addition, it is supposed that RL2 has a transfer contact. In this way, when the connection state switching part includes the relay RL1 having a make contact or a break contact, and the relay RL2 having a transfer contact, cost necessary for the connection state switching part can be reduced.

The relays RL4 and RL5 have a function of cutting off the electric power supply from the commercial power supply 201 to the heater 300. The relay RL4 becomes ON state simultaneously when the image forming apparatus becomes a standby state. In this state, the voltage detection part 202 detects a voltage of the AC power supply 201. Note that, the AC power supply 201 has a first terminal and a second terminal, and that the triac TR1 is disposed in the electric power supplying path from the second terminal of the commercial power supply to the heater. The voltage detection part 202 determines whether a range of the power supply voltage (commercial voltage range) is a 100 V system (for example, 100 V to 127 V) or a 200 V system (for example, 200 V to 240 V), and outputs the voltage detection result as a VOLT signal to the CPU 203 and the relay control part 204. If the voltage range of the power supply is the 200 V system, the VOLT signal becomes LOW state. Details of the voltage detection part 202 are described with reference to FIG. 2B.

When the voltage detection part 202 detects 200 V, the relay control part 204 operates an RL1 latch part so that RL1 is sustained in the OFF state (the state illustrated in FIG. 2A). Note that, the relay control part 204 is a safety circuit (hardware circuit) that is independent of the CPU 203. When the RL1 latch part operates, RL1 keeps the OFF state even in the case where an RL1on signal output from the CPU 203 becomes HIGH state. The relay control part 204 may operate so as to keep RL1 in the OFF state during a period when the VOLT signal is detected to be LOW state, instead of operating as the latch circuit described above.

On the other hand, the CPU 203 keeps RL2 in the OFF state (the state illustrated in FIG. 2A) according to the voltage detection result by the voltage detection part 202 (detecting 200 V). Further, when the CPU 203 outputs an RL5 on signal of HIGH state so as to turn on RL5, there occurs the state in which the image heating device (fixing device) 100 can be supplied with electric power. In this state, the first heat generating member H1 and the second heat generating member H2 are connected in series. Therefore, the heater 300 becomes the state in which the resistance value is high.

When the voltage detection part 202 detects 100 V, the CPU 203 outputs the RL1on signal of HIGH state so that the relay control part 204 turns on RL1. On the other hand, the CPU 203 outputs an RL2on signal of HIGH state according to the VOLT signal so that RL2 is turned on (to connect to the right contact). Further, when the CPU 203 outputs the RL5 on signal of the HIGH state so as to turn on RL5, there occurs the state in which the image heating device 100 can be supplied with electric power. In this state, the first heat generating member H1 and the second heat generating member H2 are connected in parallel. Therefore, the heater 300 becomes the state in which the resistance value is low.

Next, a current detection part 205 is described. The current detection part 205 detects an effective value of a current flowing in a primary side through a current transformer 206. As illustrated in FIG. 2A, the current detection part 205 is disposed in the power supply path after branching toward the first heat generating member H1 and the second heat generating member H2 in the parallel connection state of the first heat generating member H1 and the second heat generating member H2 (the connection state when the power supply voltage is 100 V). The current detection part 205 outputs Irms1 that is a square value of the effective value of current, which is obtained every period of the commercial power supply frequency, and Irms2 that is a moving average value of Irms1. The CPU 203 detects the effective value of current by Irms1 every period of the commercial frequency. As an example of the current detection part 205, it is possible to use the method proposed in Japanese Patent Application Laid-Open No. 2007-212503. On the other hand, Irms2 is output to the relay control part 204. When an overcurrent flows in the current transformer 206 so that Irms2 exceeds a predetermined threshold current value (predetermined current), the relay control part 204 operates RL1, RL4, and RL5 latch parts so as to keep RL1, RL4, and RL5 in the OFF state. Thus, power supply to the fixing device 100 (to be exact, the heater 300) is cut off. In this case, only the latch parts for RL4 and RL5 may be operated. In this embodiment, the relays RL1, RL4, and RL5 play a role of the switching part for cutting off the electric power supply to the heat generating members H1 and H2. In this way, the current detection part 205 is provided for detecting the state in which an excess current is flowing in the power supply path to the heater 300. As the case where the excess current flows, there is a case where the power supply voltage detection part 202 or the relay RL1 or RL2 as the connection state switching part fails so that the connection state of the first heat generating member H1 and the second heat generating member H2 is not suitable for the power supply voltage. This case is described later.

Next, the voltage detection part (second voltage detection part) 207 is described. The voltage detection part 207 can also be used for detecting a failure of the apparatus similarly to the current detection part 205. The voltage detection part 207 is disposed so as to detect one of voltages generate both ends of the first heat generating member H1 and generate both ends of the second heat generating member H2 in the state in which the first heat generating member H1 and the second heat generating member H2 are connected in series. The voltage detection part 207 determines whether the voltage applied to the heat generating member H1 is the 100 V system or the 200 V system. Then, if the voltage is the 200 V system, an RLoff signal that is output to the relay control part 204 is set to LOW state, so as to operate the RL1, RL4, and RL5 latch parts. Thus, RL1, RL4, and RL5 are kept to the OFF state so that power supply to the fixing device 100 is cut off. In addition, the voltage detection part 207 has a contact AC3 at a position connected directly to the terminal of RL2 for detecting voltages even if the current transformer 206 or a fuse FU2 fails by disconnection. This is because, for example, if the contact AC3 of the voltage detection part is disposed between the current transformer 206 and the connector C3, when the current transformer 206 fails by disconnection, both the current detection part 205 and the voltage detection part 207 are disabled simultaneously.

Next, current fuses FU1 and FU2 are described. These fuses also function as one of safety measures. As an example of means for cutting off a current when the excess current flows in the power supply path, the current fuses are used. The current fuses FU1 (first current fuse) and FU2 (second current fuse) cut off the electric power supply to the heat generating member H1 and the heat generating member H2, respectively, when the excess current flows.

FIG. 2B illustrates a circuit diagram illustrating the voltage detection parts 202 and 207. In this embodiment, the power supply voltage detection part 202 and the second voltage detection part 207 have the same circuit structure. The power supply voltage detection circuit 202 detects the voltage between AC1 and AC2, and the second voltage detection part 207 detects the voltage between AC3 and AC4. Because the both have the same circuit structure, the power supply voltage detection part 202 is used for describing the circuit. The action of the circuit for determining whether the voltage range applied between AC1 and AC2 is the 100 V system or the 200 V system is described. If the voltage applied between AC1 and AC2 is the 200 V system, the voltage applied between AC1 and AC2 is higher than the zener voltage of a zener diode 231 so that a current flows between AC1 and AC2. The circuit includes a reverse current prevention diode 232, a current limit resistor 234, and a protection resistor 235 for a photocoupler 233. When a current flows in the light emitting diode in the primary side of the photocoupler 233, a transistor 235 on the secondary side operates so that a current flows from Vcc through a resistor 236, and a gate voltage of an FET 237 becomes LOW state. When the FET 237 becomes OFF state, a charging current flows in a capacitor 240 through a resistor 238 from Vcc. The circuit includes a reverse current prevention diode 239 and a discharge resistor 241.

When a ratio of a period when the voltage applied between AC1 and AC2 is higher than the zener voltage of the zener diode 231 (ON Duty) increases, a ratio of OFF period of the FET 237 increases. When the ratio of OFF period of the FET 237 increases, the period when the charging current flows through the resistor 238 from Vcc increases. Therefore, the voltage of the capacitor 240 becomes a high value. When the voltage of the capacitor 240 becomes higher than a reference voltage of a comparator 242 that is a voltage divided by a resistor 243 and a resistor 244, a current flows in an output portion of the comparator 242 through a resistor 245 from Vcc, with the result that the voltage of the output portion becomes LOW state.

Figure 3A:
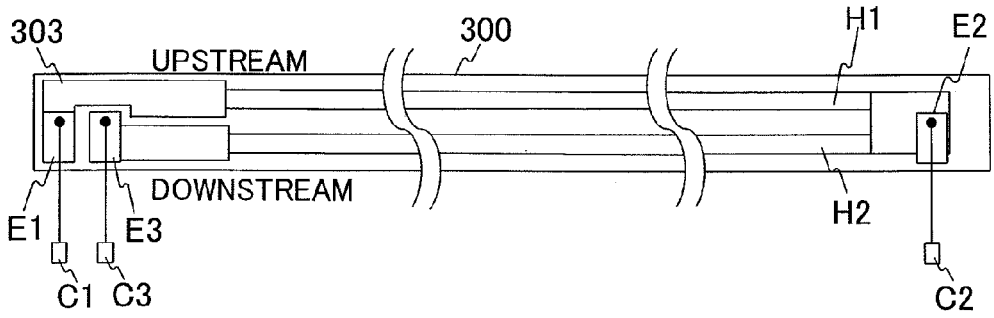
FIG. 3A is a diagram illustrating an outside structure of a heater in the first embodiment.
Figure 3B:
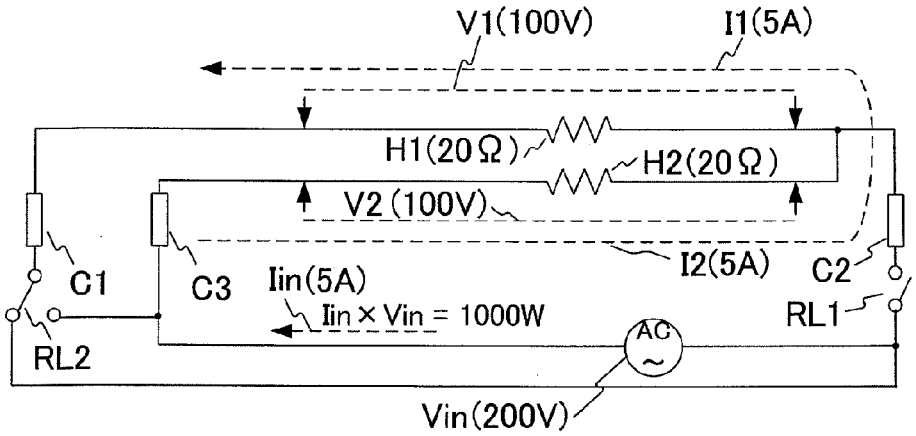
FIG. 3B is a diagram illustrating the heater in a first operating state in which a power supply voltage is 200 V in the first embodiment.
Figure 3C:
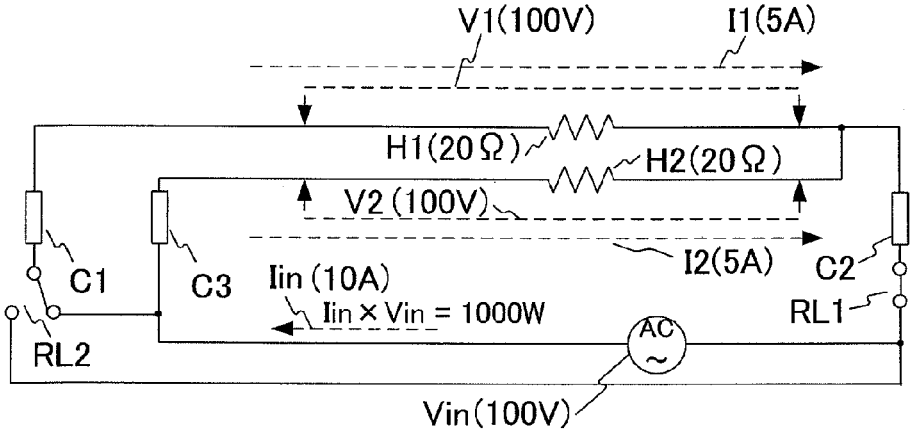
FIG. 3C is a diagram illustrating the heater in a second operating state in which the power supply voltage is 100 V in the first embodiment.

FIGS. 3A to 3C are schematic diagrams illustrating the heater 300 that is used in the first embodiment and connection states of the two heat generating members corresponding to the power supply voltage.

FIG. 3A illustrates heating patterns (heat generating members), conductive patterns, and electrodes formed on the heater substrate 105. FIG. 3A also illustrates connection parts to the connectors illustrated in FIG. 2A for describing connection to the control circuit 200 illustrated in FIG. 2A. The heater 300 includes the heat generating members H1 and H2 formed by resistance heating patterns. The heater 300 also includes a conductive pattern 303. The first heat generating member H1 of the heater 300 is supplied with electric power through an electrode E1 (first electrode) and an electrode E2 (second electrode). The second heat generating member H2 is supplied with electric power through the electrode E2 and an electrode E3 (third electrode). The electrode E1 is connected to the connector C1, the electrode E2 is connected to the connector C2, and the electrode E3 is connected to the connector C3.

Next, in the case where the power supply voltages is 100 V or 200V, the relationship between the connection status of H1 and H2 and the supplied power is explained. In the followings, each of the power and current is defined as a power or current supplied when the triac TR1 is driven by the 100% duty cycle ratio.

FIG. 3B is a diagram illustrating the connection state in the case where the power supply voltage is 200 V, that is, the first operating state in which the first heat generating member H1 and the second heat generating member H2 are connected in series. Here, for description, it is supposed that resistance values of the heat generating member H1 and the heat generating member H2 are 20Ω each. In the first operating state, because the resistors of 20Ω each are connected in series, the combined resistance value of the heater 300 is 40Ω. Because the power supply voltage is 200 V, a current of 5 A is supplied to the heater 300 so that the electric power is 1,000 W. A current I1 flowing in the first heat generating member and a current I2 flowing in the second heat generating member are 5 A each. A voltage V1 applied to the first heat generating member and a voltage V2 applied to the second heat generating member are 100 V each.

FIG. 3C is a diagram illustrating the connection state in the case where the power supply voltage is 100 V, that is, the second operating state in which the first heat generating member H1 and the second heat generating member H2 are connected in parallel. In the second operating state, because the resistors of 20Ω each are connected in parallel, the combined resistance value of the heater 300 is 10Ω. Because the power supply voltage is 100 V, a current of 10 A is supplied to the heater 300 so that the electric power is 1,000 W. The current I1 flowing in the first heat generating member and the current I2 flowing in the second heat generating member are 5 A each. The voltage V1 applied to the first heat generating member and the voltage V2 applied to the second heat generating member are 100 V each.

A current, a voltage, and electric power supplied to the heater is compared between the state of FIG. 3B and the state of FIG. 3C. When the current Iin is detected, in the state of FIG. 3B, the current value is 5 A and the electric power supplied to the heater is 1,000 W. In the state of FIG. 3C, the current value is 10 A and the electric power supplied to the heater is 1,000 W. In this way, when the current Iin is detected, the electric power is the same but the current value Iin is different between the first operating state and the second operating state. On the other hand, when the current I2 is detected, in the state of FIG. 3B, the current value is 5 A and the electric power supplied to the heater is 1,000 W. Also in the state of FIG. 3C, the current value is 5 A and the electric power supplied to the heater is 1,000 W. In this way, when the current I2 is detected, even if the operating state of the heater 300 is switched from the first operating state to the second operating state, the current value that is proportional to the electric power supplied to the heater 300 can be detected.

In addition, because the voltage value V2 applied to the heat generating member H2 is the product of the current I2 and the resistance value (20Ω), instead of the current I2, the voltage V2 applied to the heat generating member H2 may be detected. When the voltage V2 is detected, in the state of FIG. 3B, the electric power supplied to the heater is 1,000 W if the voltage value applied to the heat generating member H2 is 100 V. Also in the state of FIG. 3C, the electric power supplied to the heater is 1,000 W if the voltage value applied to the heat generating member H2 is 100 V. In this way, when the voltage V2 is detected, even if the operating state of the heater 300 is switched from the first operating state to the second operating state, the voltage value that is proportional to the electric power supplied to the heater 300 can be detected.

In addition, in the normal state illustrated in FIGS. 3B and 3C, even when the current I1 is detected, in the state of FIG. 3B, the current value is 5 A and the electric power supplied to the heater is 1,000 W. Also in the state of FIG. 3C, the current value is 5 A and the electric power supplied to the heater is 1,000 W. In addition, even when the voltage V1 is detected, in the state of FIG. 3B, the electric power supplied to the heater is 1,000 W if the voltage value applied to the heat generating member H1 is 100 V. Also in the state of FIG. 3C, the electric power supplied to the heater is 1,000 W if the voltage value applied to the heat generating member H1 is 100 V.

In this way, regardless of whether the heater is in the first operating state (serial connection state) or the second operating state (parallel connection state), by detecting the current flowing in one heat generating member (I1 or I2) or the voltage applied to one heat generating member (V1 or V2), a current or a voltage that is proportional to the electric power supplied to the heat generating member as a target can be detected.

As described above, the current detection part 205 outputs Irms1 that is a square value of the effective value of current, which is output every period of the commercial power supply frequency, and Irms2 that is the moving average value of Irms1. The CPU 203 detects the effective value of current every period of the commercial frequency by using Irms1. Even in the state in which the connection state of the relays RL1 and RL2 agrees with the state of the power supply voltage, the CPU 203 uses Irms1 for the electric power control (drive control of the triac TR1) so that the electric power supplied to the heater is kept to 1,000 W or lower.

A case is described where current limit is provided so that the electric power supplied to the heater becomes 1,000 W or lower. For example, when the current I1 or current I2 is detected, regardless of the operating state of the heater 300 (that is, regardless of whether the heater is in the serial connection state or the parallel connection state), by providing the current limit at 5 A, the electric power supplied to the heater can be limited to 1,000 W or lower. In addition, when the voltage V1 or the voltage V2 is detected, regardless of the operating state of the heater 300 (that is, regardless of whether the heater is in the serial connection state or the parallel connection state), by providing the voltage limit at 100 V, the electric power supplied to the heater can be limited to 1,000 W or lower.

As an example of the method of controlling the electric power below a predetermined value using the current detection result, the method described in Japanese Patent No. 3,919,670 can be adopted. For example, the triac TR1 is controlled so that I2 is 5 A or lower in the normal state. When an abnormal current is set to 6 A, the current I2 is controlled to 5 A or lower in the normal control. When the electric power control is disabled due to a failure of the triac TR1 or the like so that the abnormal current of 6 A or higher is detected, the CPU 203 sends a signal to the relay control part 204 so as to operate the relays RL1, RL4, and RL5 to be turned off. In this way, when the current I1 or I2, or the voltage V1 or V2 is detected, that is, by devising the connection position of the current detection part 205 or the voltage detection part 207 like this embodiment, electric power restriction (current restriction) in the normal operation can be performed only by setting one abnormal current or one abnormal voltage both in the case of the serial connection state and in the case of the parallel connection state.

Figure 4A:
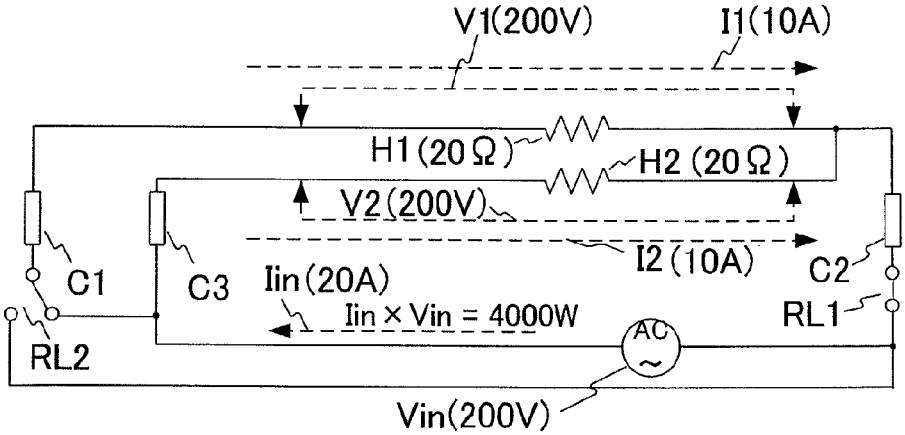
FIG. 4A is a diagram illustrating the heater in the second operating state in which the power supply voltage is 200 V in the first embodiment.
Figure 4B:
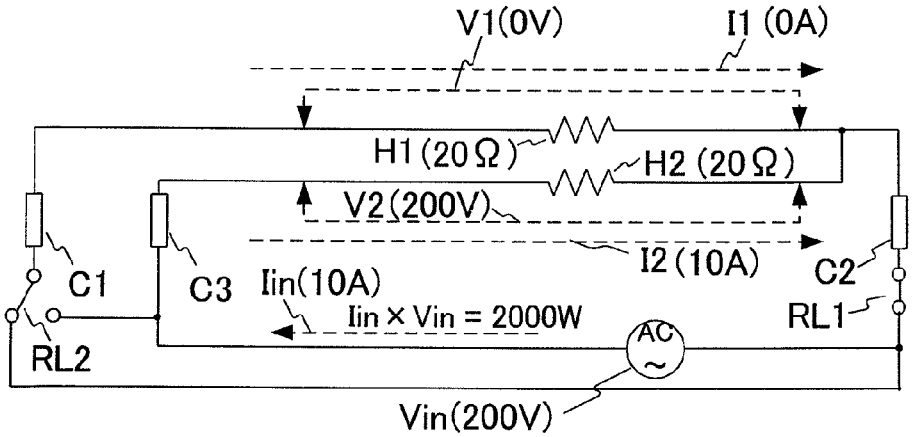
FIG. 4B is a diagram illustrating the heater in a state in which the power supply voltage is 200 V, RL1 is in ON state, and RL2 is in OFF state in the first embodiment.
Figure 4C:
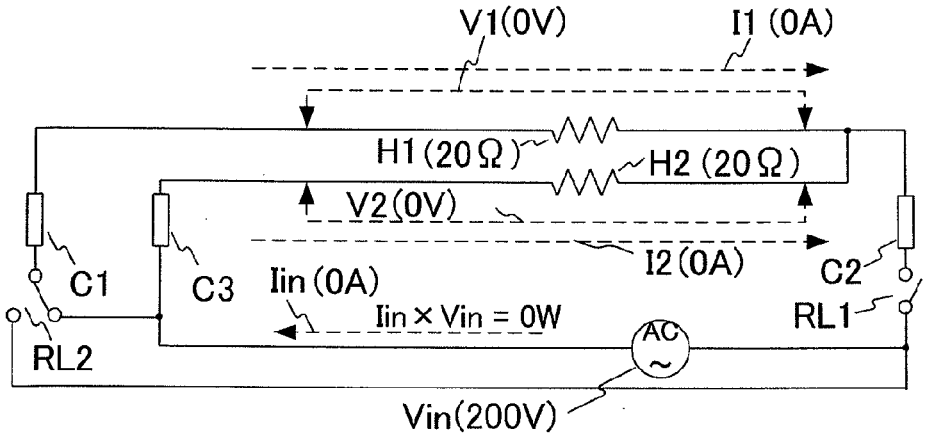
FIG. 4C is a diagram illustrating the heater in a state in which the power supply voltage is 200 V, RL1 is in the OFF state, and RL2 is in the ON state in the first embodiment.

FIGS. 4A to 4C illustrate the case where the power supply voltage detection part 202 or the relay RL1 or RL2 as the connection state switching part fails so that the connection state of the first heat generating member H1 and the second heat generating member H2 does not agree with the state of the power supply voltage.

FIG. 4A is a diagram illustrating a case where the second operating state of the low heater resistance value (that is, the parallel connection state) is set even though the power supply voltage is 200 V. In the second operating state, the combined resistance value of the heater 300 is 10Ω. Because the power supply voltage is 200 V, a current supplied to the heater 300 is 20 A, and the electric power is 4,000 W.

FIG. 4B is a diagram illustrating a case where the power supply voltage is 200 V, RL1 is in the ON state, and RL2 is in the OFF state. In this state, a current flows only in the heat generating member H2 (that is, only the heat generating member H2 generates heat), and the combined resistance value of the heater 300 is 20Ω. Because the power supply voltage is 200 V, the current supplied to the heater 300 is 10 A, and the electric power is 2,000 W.

FIG. 4C is a diagram illustrating a case where the power supply voltage is 200 V, RL1 is in the OFF state, and RL2 is in the ON state. In this state, because there is no path for supplying a current to the heater 300, electric power is not supplied to the heater 300.

Among the failure states described above, it is necessary to detect particularly the failure states illustrated in FIGS. 4A and 4B in which larger electric power is supplied to the heater 300 than in the normal state. In those failure states, because the electric power supplied to the heater becomes too high, the safety circuit using a temperature detecting element such as the thermistor 111, the thermal fuse FU1 or FU2, or the thermo-switch 112 may be insufficient in the response speed for cutting off the electric power supply to the heater. If the cutting off of the electric power is delayed, the heater may be broken by thermal stress in the case of the fixing device that uses a ceramic heater.

A current, a voltage, and electric power supplied to the heater is compared between the failure states illustrated in FIGS. 4A and 4B. When the current Iin is detected, in FIG. 4B, the current value of the current Iin is 10 A and the electric power supplied to the heater 300 is 2,000 W. Because the current value is the same as the current Iin in the normal state illustrated in FIG. 3C, the failure state may not be detected only by the current detection result of the current Iin.

When the current I1 is detected, in FIG. 4B, the current value of the current I1 is 0 A and the electric power supplied to the heater 300 is 2,000 W. In the state in which electric power is supplied to the heater 300, because the current I1 does not flow, the failure state may not be detected only by the current detection result of the current I1 as illustrated in FIG. 4B. When the current I2 is detected, the current value of 10 A that is twice as large as the current value in the normal state described above with reference to FIGS. 3A to 3C can be detected regardless of the failure state of the relay RL1 or the relay RL2. Therefore, the failure state illustrated in FIG. 4A or 4B can be detected. When the voltage V2 is detected, the voltage value of 200 V (overvoltage) that is twice as large as the voltage value in the normal state described above with reference to FIGS. 3A to 3C can be detected regardless of the failure state of the relay RL1 or the relay RL2. Therefore, the failure states illustrated in FIGS. 4A and 4B can be detected. In this way, each of the failure states illustrated in FIGS. 4A and 4B can be detected by detecting the current I2 flowing in the second heat generating member H2 between the electrode E2 and the electrode E3, or by detecting the voltage V2 applied to the second heat generating member H2. Note that, the heat generating member H2 to be detected by the current detection part 205 or the voltage detection part 207 is the heat generating member that is connected to the commercial power supply 201 without the relay RL2 having the transfer contact.

As described above, the current detection part 205 is disposed in the power supply path after branching toward the first heat generating member H1 and the second heat generating member H2 in the parallel connection state. In particular, in the structure in which connection of the two heat generating members is switched between the serial connection state and the parallel connection state by combination of the relay RL1 having the make contact or the break contact and the relay RL2 having the transfer contact, it is preferred to dispose the current detection part 205 in the power supply path of the heat generating member H2 that is connected to the commercial power supply 201 without the relay RL2 having the transfer contact.

In addition, the second voltage detection part 207 is disposed so as to detect one of voltages generate both ends of the first heat generating member H1 and generate both ends of the second heat generating member H2 in the serial connection state. In particular, in the structure in which connection of the two heat generating members is switched between the serial connection state and the parallel connection state by combination of the relay RL1 having the make contact or the break contact and the relay RL2 having the transfer contact, it is preferred to dispose the voltage detection part 207 so as to detect the voltage generate both ends of the heat generating member H2 that is connected to the commercial power supply 201 without the relay RL2 having the transfer contact.

In addition, the current fuse FU1 is used in the current path flowing in the first heat generating member H1, and the current fuse FU2 is used in the current path flowing in the second heat generating member H2. Thus, the current fuse FU1 and the current fuse FU2 operate in the failure state illustrated in FIG. 4A, while the current fuse FU1 operates in the failure state illustrated in FIG. 4B. When the current fuse FU1 is used in the current path flowing in the first heat generating member H1 and the current fuse FU2 is used in the current path flowing in the second heat generating member H2, it is possible to provide an overcurrent cutting off unit corresponding to the failure states illustrated in FIGS. 4A and 4B, respectively.

Figures 5, 5A, 5B:
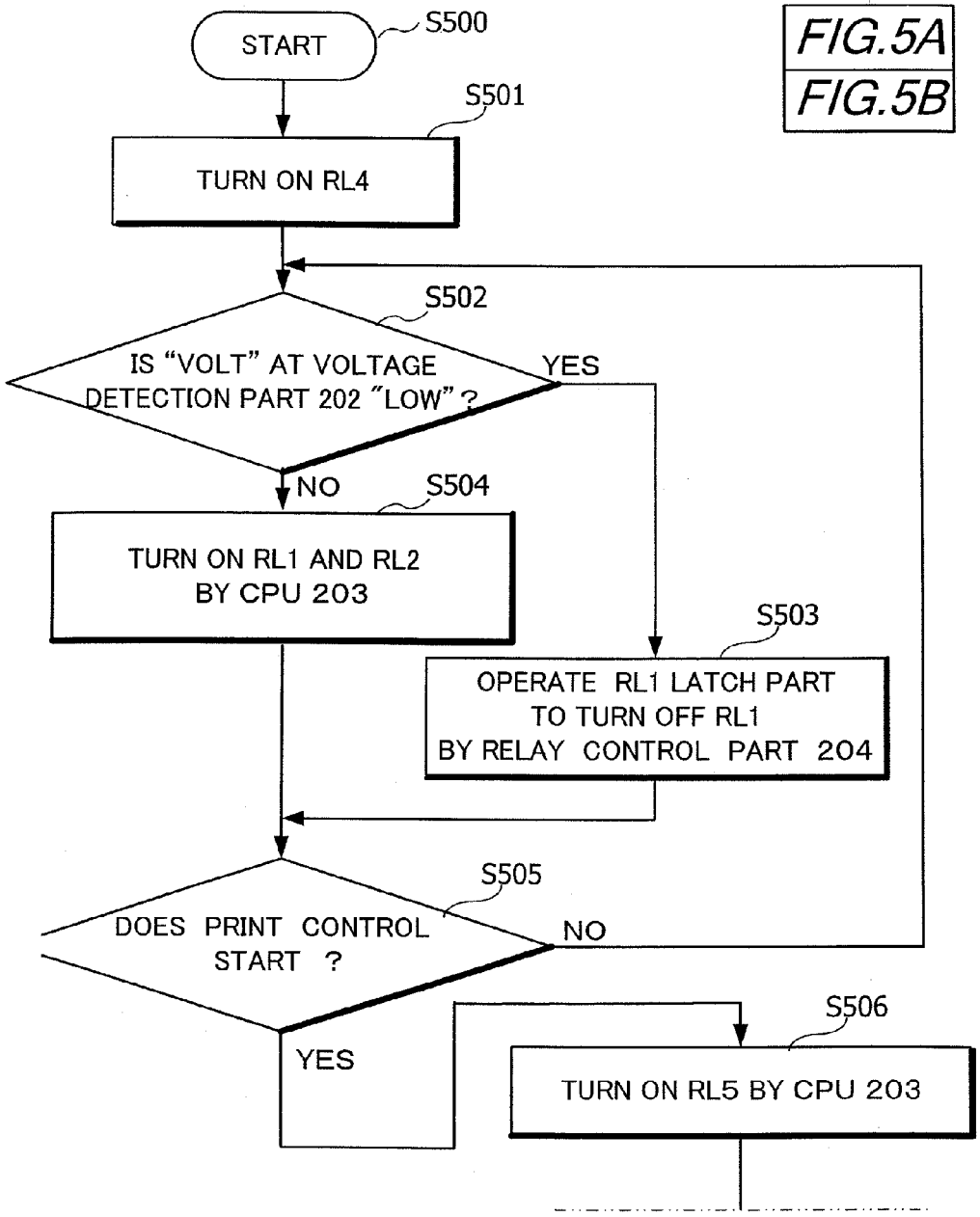
FIG. 5A is a control flowchart of the first embodiment.
FIG. 5 is comprised of FIGS. 5A and 5B.
FIG. 5B is a control flowchart of the first embodiment.
Figure 5B:
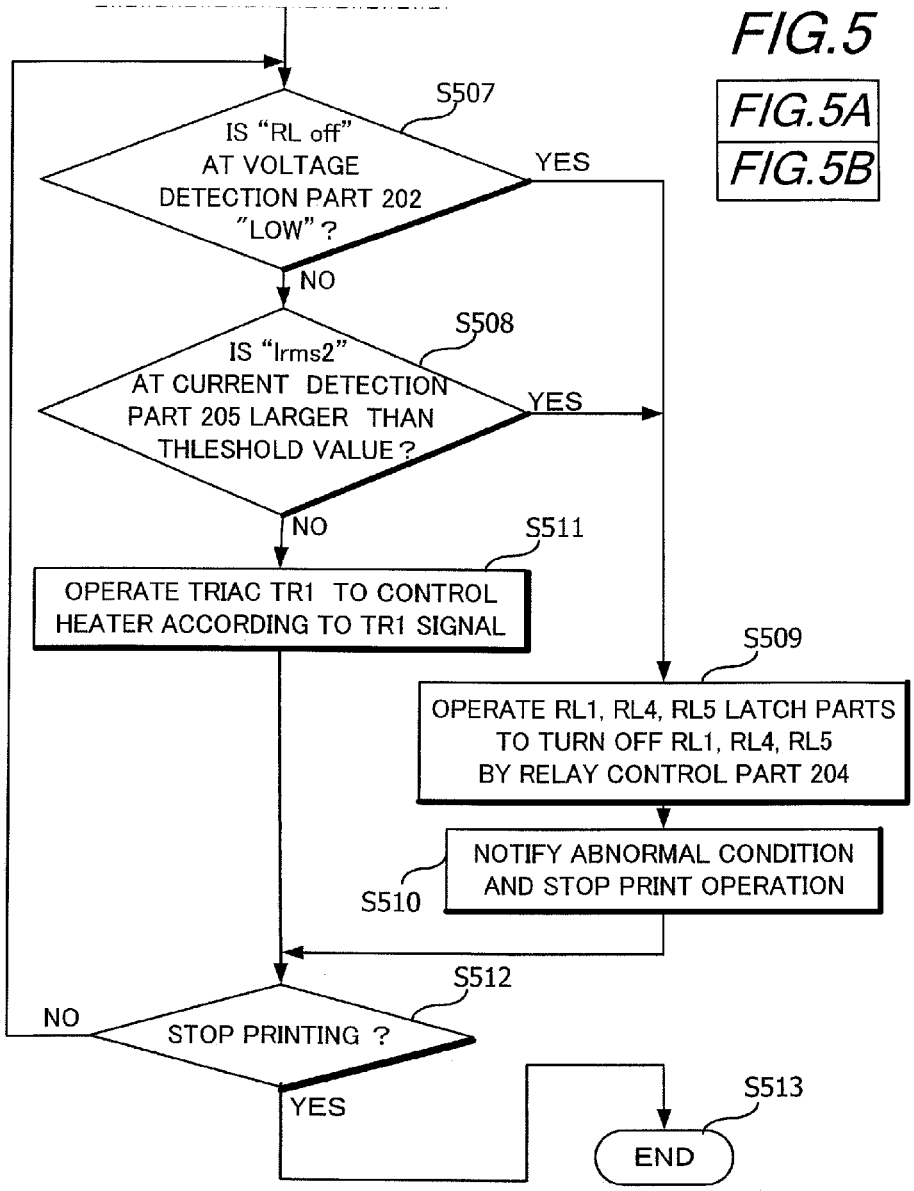

FIGS. 5A and 5B are flowcharts illustrating a control sequence of the fixing device 100 by the CPU 203 and the relay control part 204 of the first embodiment of the present invention.

In S500, when the control circuit 200 becomes the standby state, the control starts and the process flow proceeds to S501. In S501, the relay control part 204 turns on RL4. In S502, the power supply voltage range is determined based on the VOLT signal that is an output of the voltage detection part. If the power supply voltage is the 100 V system, the process flow proceeds to S504. If the power supply voltage is the 200 V system, the process flow proceeds to S503. In S503, the relay RL1 latch part of the relay control part 204 operates so that the relay RL1 is kept in the OFF state, and the process flow proceeds to S505. In S504, the CPU 203 outputs the RL1on signal and the RL2on signal of HIGH state to the relay control part 204, and hence the relay control part 204 turns on RL1 and RL2, and the process flow proceeds to S505. Until print control start is determined in S505, the process from S502 to S504 is performed repeatedly. When the print control is started, the process flow proceeds to S506.

In 5506, the CPU 203 outputs the RL5 on signal of HIGH state to the relay control part 204, and hence the relay control part 204 turns on RL5.

In S507, if the voltage detection part 207 detects a voltage higher than a predetermined voltage, that is, detects overvoltage, the RLoff signal is in LOW state, and the process flow proceeds to S509.

In S508, if the voltage based on the output Irms2 of the current detection part 205 becomes a predetermined threshold voltage value or higher, the process flow proceeds to S509.

In S509, the relay control part 204 operates the RL1, RL4, and RL5 latch parts so that RL1, RL4, and RL5 are kept in the OFF state (cut off state), and the process flow proceeds to S510. In S510, an abnormal state is notified of so that the print operation is brought to an emergency stop, and the process flow proceeds to S513 to finish the control. If the abnormal state is not detected in S507 and S508, the process flow proceeds to S511. In S511, the CPU 203 controls the triac TR1 using PI control based on the TH signal output from the temperature detecting element 111 and the Irms1 signal output from the current detection part, so as to control the electric power to be supplied to the heater 300 (as phase control or wave number control). Until the end of print is determined in S512, the process from S507 to S511 is repeated. When the print is finished, the process flow proceeds to S513 to finish the control.

In this way, in the image forming apparatus having the structure in which connection of two heat generating members is switched between the serial connection state and the parallel connection state, at least one of the current detection part 205 and the voltage detection part 207 is provided and the arrangement position thereof is devised like this embodiment. Thus, a failure of the apparatus can be detected, and hence reliability of the apparatus can be improved.

Second Embodiment

Description of the same structure as in the first embodiment is omitted.

Figure 6:
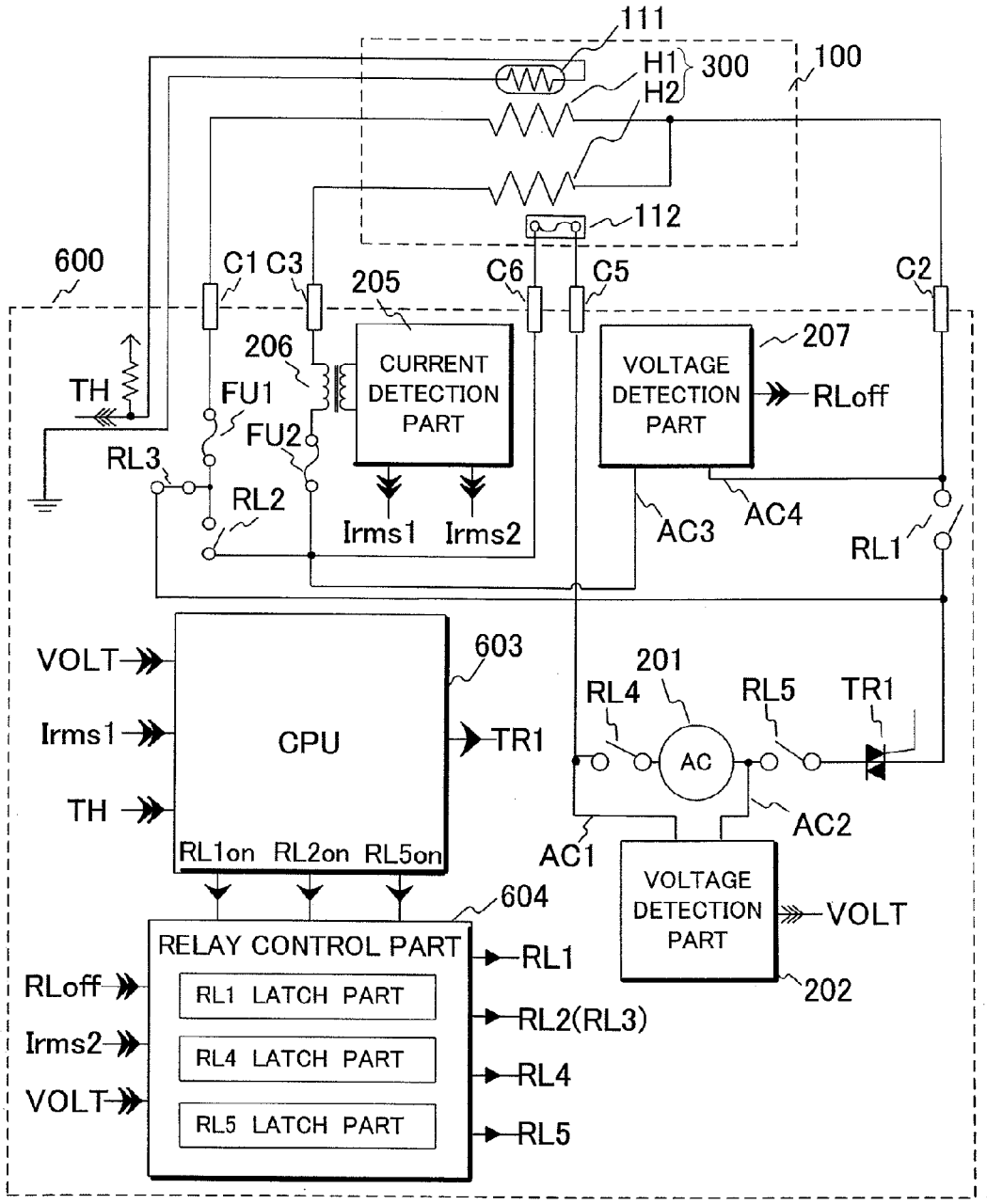
FIG. 6 illustrates a structure of a heater control circuit of a second embodiment.

FIG. 6 illustrates a control circuit 600 of the heater 300 of a second embodiment. In FIG. 6, only the structure of the connection state switching part (relay) is different from that in the first embodiment. The arrangement of the current detection part 205 and the voltage detection part 207 is the same as that in the first embodiment, and hence description of the arrangement thereof is omitted.

The voltage detection part and the relay control part are described below. FIG. 6 illustrates RL1, RL2, RL3, RL4, and RL5 indicating connection states of the contacts in the power supply OFF state. Note that, it is supposed that RL1 has a make contact or a break contact. In addition, it is supposed that RL2 has a make contact. Further, it is supposed that RL3 has a break contact. When the voltage detection part 202 detects 200 V, a relay control part 604 operates the RL1 latch part so that the relay RL1 is turned off. A CPU 603 turns off RL2 (to be non-conductive state) according to the voltage detection result, and then off on RL3 (to be conductive state). RL3 has a feature that RL3 operates together with RL2, and RL2 is controlled not to become the conductive state simultaneously with RL3 (not to become the state in which RL2 is ON while RL3 is OFF) with a time difference. The combination of RL2 and RL3 has the same action as RL2 in the first embodiment. Further, when RL5 is turned on, the fixing device 100 can be supplied with electric power. In this state, because the first heat generating member H1 and the second heat generating member H2 are connected in series, the heater 300 has a high resistance value. If the voltage detection part 202 detects 100 V, the CPU 603 outputs the RL1on signal of HIGH state so that the relay control part 604 turns on RL1. The CPU 603 outputs an RL3 on signal of HIGH state according to the voltage detection result so that RL3 is turned on (to be non-conductive state), and then RL2 is turned on (to be conductive state). Further, when RL5 is turned on, the fixing device 100 can be supplied with electric power. In this state, because the first heat generating member H1 and the second heat generating member H2 are connected in parallel, the heater 300 has a low resistance value.

In this way, also in the structure of the connection state switching part like the control circuit 600, a failure of the apparatus can be detected so that reliability of the apparatus can be improved, by providing at least one of the current detection part 205 and the voltage detection part 207 and by devising the arrangement position thereof as in this embodiment.

Third Embodiment

Description of the same structure as in the first embodiment is omitted.

Figure 7:
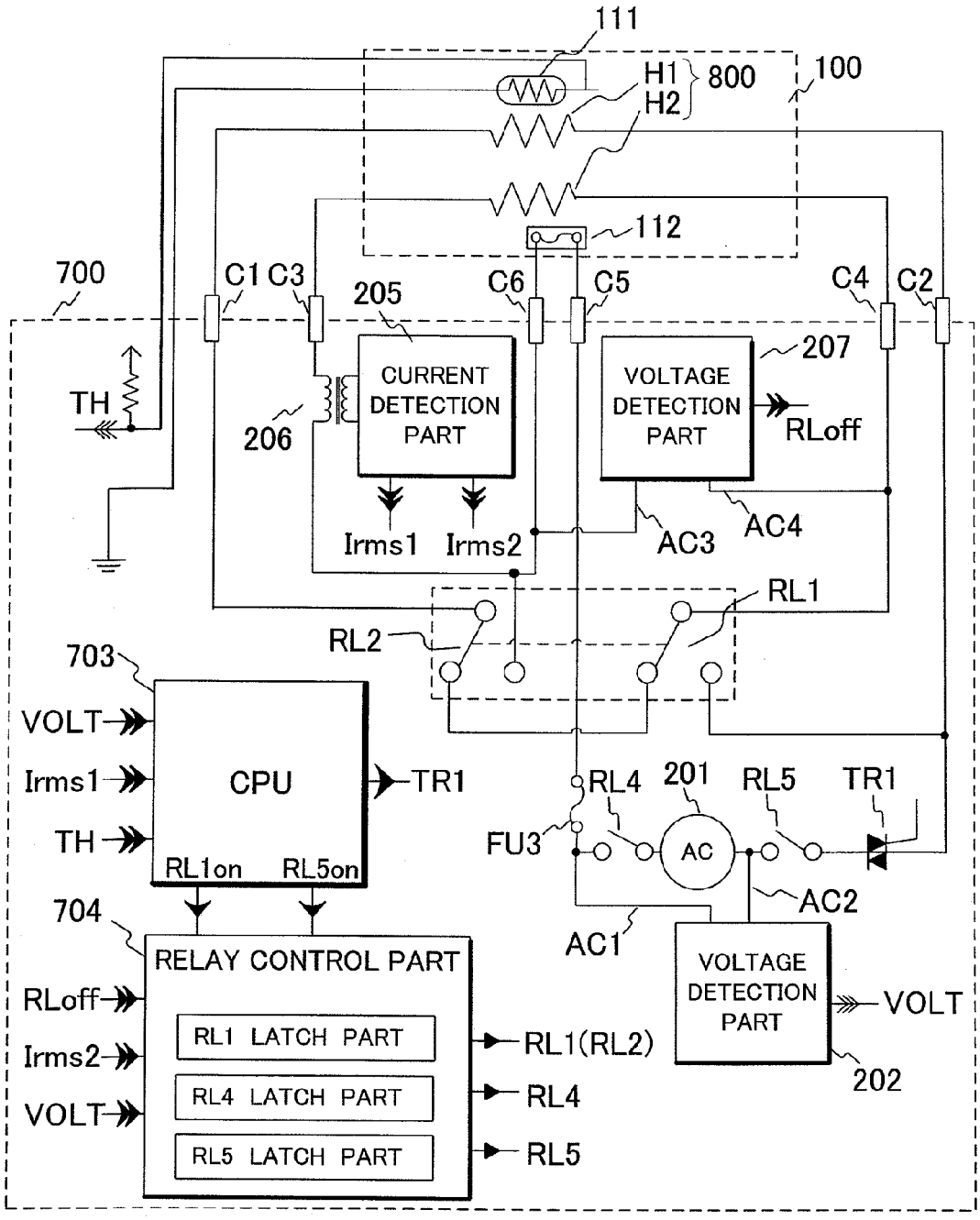
FIG. 7 illustrates a structure of a heater control circuit of a third embodiment.

FIG. 7 illustrates a control circuit 700 of a heater 800 of a third embodiment. In FIG. 7, only the structure of the connection state switching part (relay) and the increased number of electrodes of the heater are different from those in the first embodiment. The arrangement of the current detection part 205 and the voltage detection part 207 is the same as that in the first embodiment.

The voltage detection part and the relay control part are described below. FIG. 7 illustrates RL1, RL2, RL4, and RL5 indicating connection states of the contacts in the power supply OFF state. When the voltage detection part 202 detects 200 V, a relay control part 704 operates the RL1 latch part so that RL1 is kept in the OFF state. RL2 has a feature to operate together with RL1, and RL2 becomes the OFF state simultaneously with RL1. Further, when RL5 is turned on, the fixing device 100 can be supplied with electric power. In this state, because the first heat generating member H1 and the second heat generating member H2 are connected in series, the heater 800 has a high resistance value. If the voltage detection part 202 detects 100 V, the relay control part 704 turns on RL1. RL2 has a feature to operate together with RL1, and RL2 becomes the ON state simultaneously with RL1. Further, when RL5 is turned on, the fixing device 100 can be supplied with electric power. In this state, because the first heat generating member H1 and the second heat generating member H2 are connected in parallel, the heater 800 has a low resistance value.

Figure 8A:
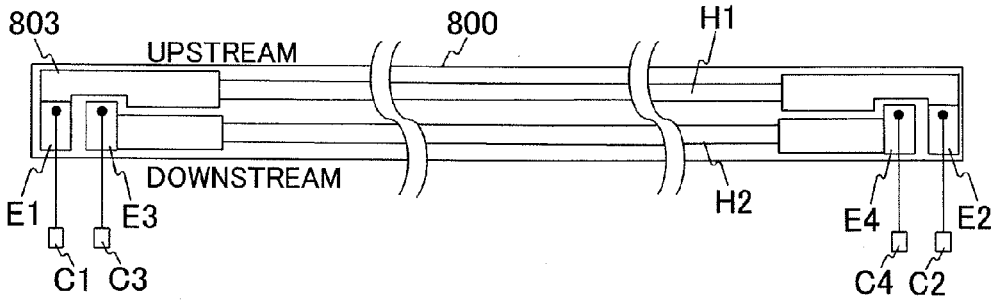
FIG. 8A is a diagram illustrating an outside structure of a heater of the third embodiment.
Figure 8B:
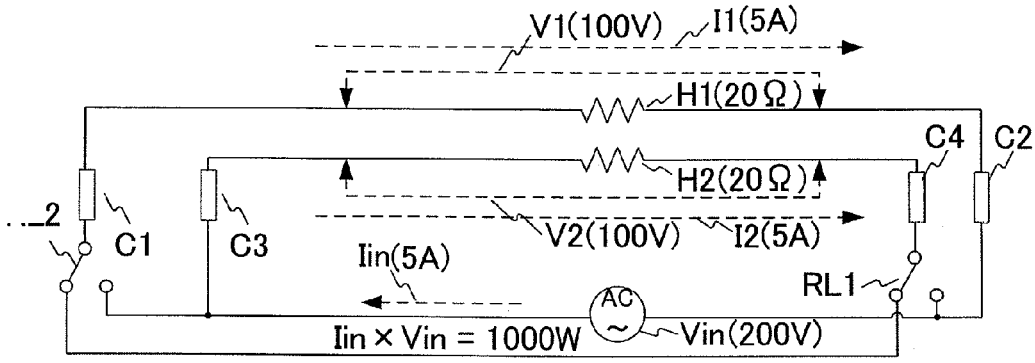
FIG. 8B is a diagram illustrating the heater in the first operating state in which the power supply voltage is 200 V in the third embodiment.
Figure 8C:
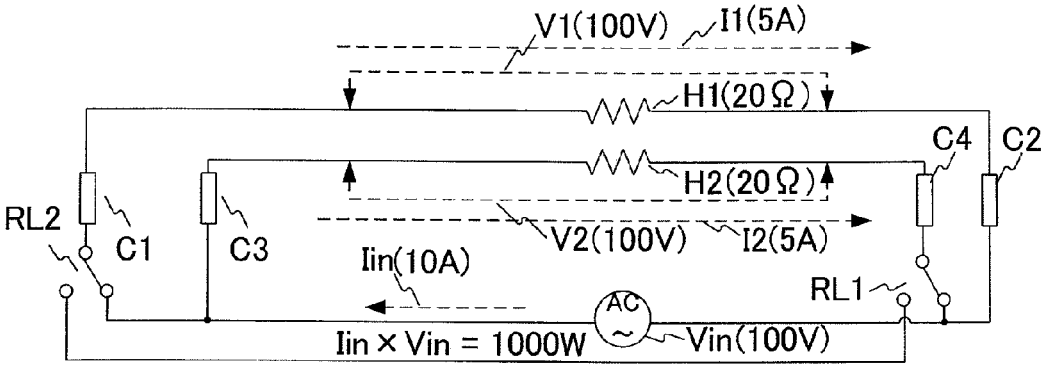
FIG. 8C is a diagram illustrating the heater in the second operating state in which the power supply voltage is 100 V in the third embodiment.

FIGS. 8A to 8C are schematic diagrams illustrating the heater 800 used for the third embodiment, and heat generating members of the heater 800.

FIG. 8A illustrates heating patterns, conductive patterns, and electrodes formed on the substrate. In addition, in order to illustrate connection to the control circuit 700 illustrated in FIG. 7, the schematic diagram of FIG. 7 is illustrated.

The heater 800 includes the heat generating members H1 and H2 formed by resistance heating patterns. The heater 800 also includes a conductive pattern 803. The first heat generating member H1 of the heater 800 is supplied with electric power through the electrodes E1 and E2, and the second heat generating member H2 is supplied with electric power through the electrodes E3 and E4. The electrode E1 is connected to the connector C1, the electrode E2 is connected to the connector C2, the electrode E3 is connected to the connector C3, and the electrode E4 (fourth electrode) is connected to the connector C4.

FIG. 8B is a diagram illustrating the first operating state in which the first heat generating member and the second heat generating member are connected in series when the power supply voltage is 200 V.

Here, for description, it is supposed that resistance values of the heat generating member H1 and the heat generating member H2 are 20Ω each. In the first operating state, because the resistors of 20Ω each are connected in series, the combined resistance value of the heater 800 is 40Ω. Because the power supply voltage is 200 V, a total current Iin of 5 A is supplied to the heater 800 so that the electric power supplied to the heater is 1,000 W. The current I1 flowing in the first heat generating member and the current I2 flowing in the second heat generating member are 5 A each. The voltage V1 of the first heat generating member and the voltage V2 of the second heat generating member are 100 V each.

FIG. 8C is a diagram illustrating the second operating state in which the first heat generating member and the second heat generating member are connected in parallel when the power supply voltage is 100 V. In the second operating state, because the resistors of 20Ω each are connected in parallel, the combined resistance value of the heater 800 is 10Ω. Because the power supply voltage is 100 V, the total current Iin of 10 A is supplied to the heater 800 so that the electric power supplied to the heater is 1,000 W. The current I1 flowing in the first heat generating member H1 and the current I2 flowing in the second heat generating member H2 are 5 A each. The voltage V1 of the first heat generating member and the voltage V2 of the second heat generating member are 100 V each.

Figure 8D:
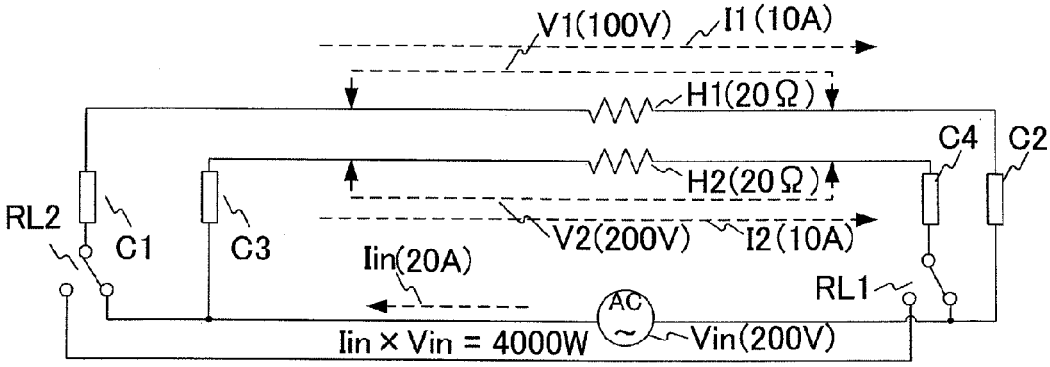
FIG. 8D is a diagram illustrating the heater in the second operating state in which the power supply voltage is 200 V in the third embodiment.

FIG. 8D is a diagram illustrating a case where the second operating state of the low heater resistance value, in which the first heat generating member and the second heat generating member are connected in parallel, is set due to a failure of the voltage detection part 202 or the relay control part 704 even though the power supply voltage is 200 V. In the control circuit 700, for example, because RL1 and RL2 operate together even if the driving circuit or the voltage detection part 202 on the secondary side of RL1 and RL2 fails, a failure state of the control circuit 700 can be limited to the state illustrated in FIG. 8D. In the second operating state, because the resistors of 20Ω are connected in parallel, the combined resistance value of the heater 800 is 10Ω. Because the power supply voltage is 200 V, the total current Iin of the heater 800 is 20 A, and the electric power is 4,000 W. The current I1 of the first heat generating member H1 and the current I2 of the second heat generating member H2 are 10 A each. The voltage V1 of the first heat generating member and the voltage V2 of the second heat generating member are 200 V each.

A current, a voltage, and electric power supplied to the heater is compared between the state of FIG. 8B and the state of FIG. 8C. When the current Iin is detected, in the state of FIG. 8B, the current Iin is 5 A and the electric power supplied to the heater is 1,000 W. In the state of FIG. 8C, the current Iin is 10 A and the electric power supplied to the heater is 1,000 W. In this way, when the current Iin is detected, the electric power is the same but the current value Iin is different between the first operating state and the second operating state. On the other hand, when the current I1 is detected, in the state of FIG. 8B, the current value of I1 is 5 A and the electric power supplied to the heater is 1,000 W. Also in the state of FIG. 8C, the current value of I1 is 5 A and the electric power supplied to the heater is 1,000 W. I2 is the same as I1. In addition, when the voltage V1 is detected, the voltage V1 is 100 V and the electric power supplied to the heater is 1,000 W in the state of FIG. 8B. Also in the state of FIG. 8C, the voltage V1 is 100 V and the electric power supplied to the heater is 1,000 W. V2 is the same as V1. In this way, when the current I1 or I2, or the voltage V1 or V2 is detected, even if the operating state of the heater 800 is switched from the first operating state to the second operating state, the current value or the voltage value that is proportional to the electric power supplied to the heater 800 can be detected.

In this way, even with the structure of the connection state switching part like this embodiment, a failure of the apparatus can be detected by devising the arrangement position of the current detection part 205 and the voltage detection part 207.

The three embodiments described above described are based on the image forming apparatus including the fixing part that uses the endless belt. However, the present invention may also be applied to an image forming apparatus including a fixing part having other structure without the endless belt as long as connection of two heat generating members is switched between the serial connection state and the parallel connection state in the structure of the fixing part.

In addition, the above description is based on the image forming apparatus having the structure in which connection of the two heat generating members is automatically switched between the serial connection state and the parallel connection state according to the detected voltage of the power supply voltage detection part. However, the present invention may also be applied to an image forming apparatus having a structure in which connection of the two heat generating members is switched manually between the serial connection state and the parallel connection state.

In addition, the above description is based on the apparatus including both the current detection part 205 and the voltage detection part 207, but it is sufficient to dispose one of the current detection part 205 and the voltage detection part 207.

In addition, the above description is based on the structure in which the current detection part 205 is disposed in one of the power supply paths after branching toward the first heat generating member H1 and the second heat generating member H2 in the parallel connection state, but the current detection part 205 may be disposed in each of the power supply paths after branching.

In addition, the above description is based on the structure in which only one voltage detection part 207 is disposed for detecting one of voltages generate both ends of the first heat generating member H1 and generate both ends of the second heat generating member H2 in the serial connection state, but the voltage detection part 207 may be disposed for each of the heat generating members.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-062464, filed Mar. 18, 2010, and Japanese Patent Application No. 2011-024986, filed Feb. 8, 2011, which are hereby incorporated by reference herein in their entirety.

The invention claimed is:

1. An image forming apparatus, comprising:

a fixing part including a first heat generating member and a second heat generating member which generate heat by electric power supplied from a commercial power supply through a power supply path to heat-fix an image formed on a recording material to the recording material;

a connection state switching part which switches connection of the first heat generating member and the second heat generating member between a serial connection state and a parallel connection state, the connection state switching part including a relay having one of a make contact and a break contact, and a relay having a transfer contact; and a current detection part which detects a current flowing in the power supply path, wherein the current detection part is disposed in the power supply path after branching toward the first heat generating member and the second heat generating member in the parallel connection state, and wherein the current detection part is disposed in the power supply path for one of the first heat generating member and the second heat generating member that is connected to the commercial power supply without the relay having the transfer contact.

2. An image forming apparatus according to claim 1, further comprising:

a power supply voltage detection part which detects a voltage of the commercial power supply; and a control part which controls the connection state switching part according to the voltage detected by the power supply voltage detection part.

3. An image forming apparatus according to claim 1, further comprising a switching part disposed in the power supply path, wherein when the current detected by the current detection part exceeds a predetermined current, the switching part is driven so that electric power supply to the first heat generating member and the second heat generating member is cut off.

4. An image forming apparatus according to claim 1, wherein the fixing part includes:

an endless belt;

a heater including the first heat generating member and the second heat generating member, which is brought into contact with an inner surface of the endless belt; and a nip part forming member which forms a nip part for subjecting the recording material to fixing processing, together with the heater through the endless belt.

5. An image forming apparatus comprising:

a fixing part including a first heat generating member and a second heat generating member which generate heat by electric power supplied from a commercial power supply through a power supply path to heat-fix an image formed on a recording material to the recording material;

a connection state switching part which switches connection of the first heat generating member and the second heat generating member between a serial connection state and a parallel connection state;

a current detection part which detects a current flowing in the power supply path, and a voltage detection part which detects a voltage, wherein the current detection part is disposed in the power supply path after branching toward the first heat generating member and the second heat generating member in the parallel connection state, and wherein the voltage detection part is disposed so as to detect one of a voltage between both ends of the first heat generating member and a voltage between both ends of the second heat generating member in the serial connection state.

6. An image forming apparatus, comprising:

a fixing part including a first heat generating member and a second heat generating member which generate heat by electric power supplied from a commercial power supply through a power supply path to heat-fix an image formed on a recording material to the recording material;

a connection state switching part which switches connection of the first heat generating member and the second heat generating member between a serial connection state and a parallel connection state, the connection state switching part including a relay having one of a make contact and a break contact, and a relay having a transfer contact; and a voltage detection part which detects a voltage, wherein the voltage detection part is disposed so as to detect one of a voltage between both ends of the first heat generating member and a voltage between both ends of the second heat generating member in the serial connection state, and that is connected to the commercial power supply without the relay having the transfer contact.

7. An image forming apparatus according to claim 6, further comprising:

a power supply voltage detection part which detects a voltage of the commercial power supply; and a control part which controls the connection state switching part according to the voltage detected by the power supply voltage detection part.

8. An image forming apparatus according to claim 6, further comprising a switching part disposed in the power supply path, wherein when the voltage detected by the voltage detection part exceeds a predetermined voltage, the switching part is driven so that electric power supply to the first heat generating member and the second heat generating member is cut off.

9. An image forming apparatus according to claim 6, wherein the fixing part includes:

an endless belt;

a heater including the first heat generating member and the second heat generating member, which is brought into contact with an inner surface of the endless belt; and a nip part forming member which forms a nip part for subjecting the recording material to fixing processing, together with the heater through the endless belt.

* * * * *